US006097317A

United States Patent [19]

Lewiner et al.

[11] Patent Number: 6,097,317

[45] **Date of Patent: *Aug. 1, 2000**

[54] PORTABLE APPLIANCE FOR INFORMING THE USERS OF A BUS NETWORK ABOUT WAITING TIMES AT STOPS IN THE NETWORK

[75] Inventors: Jacques Lewiner, Saint-Cloud; Eric Carreel, Paris, both of France

[73] Assignee: J. C. Decaux International, Neuilly sur Seine-France

[ * ] Notice: This patent issued on a continued prosecution application filed under 37 CFR 1.53(d), and is subject to the twenty year patent term provisions of 35 U.S.C. 154(a)(2).

[21] Appl. No.: 08/841,354

[22] Filed: Apr. 30, 1997

[30] Foreign Application Priority Data

May 3, 1996 [FR] France ..... 96 05561

[51] Int. Cl.[7] ..... G08G 1/123

[52] U.S. Cl. ..... 340/994; 340/991; 701/117

[58] Field of Search ..... 340/994, 993, 340/991, 988; 701/117, 200

[56] References Cited

U.S. PATENT DOCUMENTS

| | | | |
|---|---|---|---|
| 4,799,162 | 1/1989 | Shinkawa et al. . | |
| 5,172,092 | 12/1992 | Nguyen et al. | 340/311.1 |
| 5,461,374 | 10/1995 | Lewiner et al. | 340/994 |
| 5,483,454 | 1/1996 | Lewiner et al. . | |
| 5,493,295 | 2/1996 | Lewiner et al. | 340/994 |
| 5,657,010 | 8/1997 | Jones | 340/994 |
| 5,724,243 | 3/1998 | Westerlage et al. | 340/994 |
| 5,736,940 | 4/1998 | Burgeher | 340/994 |

FOREIGN PATENT DOCUMENTS

| | | |
|---|---|---|
| 0 622 769 A1 | 2/1994 | European Pat. Off. . |
| 2 694 114 | 1/1994 | France . |
| 2 704 965 | 11/1994 | France . |
| WO 93/13510 | 7/1993 | WIPO . |
| WO 94/02922 | 2/1994 | WIPO . |
| WO 94/02923 | 2/1994 | WIPO . |

OTHER PUBLICATIONS

Burgener et al., "A Personal Transit Arrival Time Receiver, "0 IEEE–IEE Vehicle Navigation & Information Systems Conference, Ottawa—VNIS '93.

French Search Report dated Jan. 13, 1997, French Appl. No. FR 9605561.

*Primary Examiner*—Brent A. Swarthout

*Attorney, Agent, or Firm*—Marshall, O'Toole, Gerstein, Murray & Borun

[57] ABSTRACT

The portable appliance informs users about waiting times at stops in a bus network, the appliance comprising a radio receiver to receive data enabling waiting times to be determined, an interrogation keypad, a central unit for evaluating the estimated time of arrival of the next bus at a particular stop, a screen for displaying the waiting time for said bus, and a sound emitter. The central unit is designed to update cyclically the estimated time of arrival for the next bus and to actuate the sound emitter when said estimated time of arrival differs excessively from the time of arrival initially estimated the last time the appliance was interrogated by the user.

11 Claims, 1 Drawing Sheet

FIG. 1.
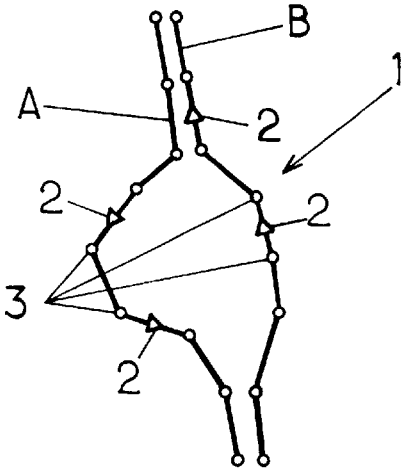
FIG. 2.
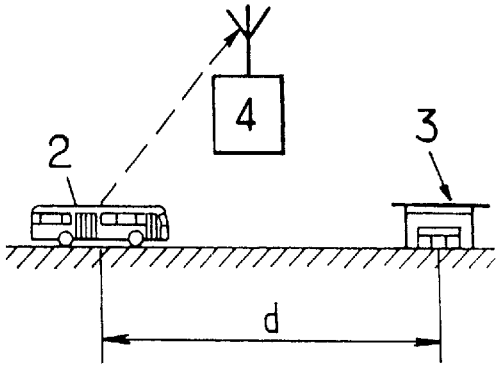
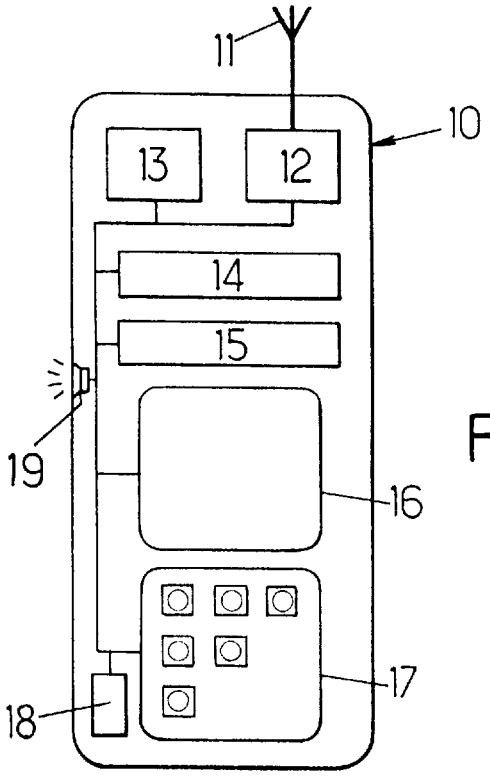
FIG. 3.

PORTABLE APPLIANCE FOR INFORMING THE USERS OF A BUS NETWORK ABOUT WAITING TIMES AT STOPS IN THE NETWORK

The invention relates to portable appliances for informing the users of a bus network about waiting times at stops in the network, or at least about waiting time at at least one stop on at least one bus route belonging to the network.

BACKGROUND OF THE INVENTION

The term "bus" is used herein not only for buses proper, but also for any similar urban surface public transport vehicle which is subject to the hazards of urban road travel in the same manner as private vehicles.

Amongst portable appliances of the above-mentioned type, the invention relates more particularly to those which comprise:

radio receiver means for receiving by radio data enabling the above-mentioned waiting times to be known;

interrogation means actuatable by a user to access waiting time information to inform said user on at least the waiting time for a certain bus at the stop under consideration on the route under consideration, said waiting time information corresponding to a certain estimated time of arrival for the bus under consideration at the stop under consideration; and interface means controlled by an electronic central unit for communicating said waiting time information to the user.

Document WO-A-94/02923 describes an example of such a portable appliance.

That portable appliance operates in satisfactory manner so long as bus drivers continue to drive in a consistent, regular manner, being influenced solely by traffic conditions.

However, from time to time a bus driver who was initially driving in a calm and prudent manner may suddenly take to driving quickly, or conversely a driver who was originally driving quickly may suddenly take to driving slowly, and this can happen independently of traffic conditions.

Such sudden and unforeseeable changes in the behavior of a bus driver can make earlier estimates of the portable appliance concerning the time of arrival of the bus at a given stop quite irrelevant.

Thus, when a bus driver changes suddenly from driving slowly to driving quickly, the bus will reach the next stop sooner than the time of arrival that could be estimated while the driver was driving slowly.

A user who consulted the portable appliance while the driver was driving slowly can thus reach the bus stop at the initially estimated time of arrival, i.e. after the bus has already arrived, thereby running the risk of the user missing the bus.

Conversely, if a driver has switched suddenly from driving quickly to driving slowly, then the bus will arrive at the next stop later than the time of arrival that was initially estimated while the driver was driving quickly.

In this way, a user who has consulted the portable appliance while a driver was driving quickly will arrive at the bus stop at the initially estimated time of arrival for the bus, and will then have to wait unexpectedly for the bus.

OBJECTS AND SUMMARY OF THE INVENTION

The present invention seeks in particular to mitigate the above drawbacks.

According to the invention, a portable appliance of the kind in question further includes signalling means suitable for attracting the user's attention; and the central unit is adapted:

to store at least data representative of the initially estimated time of arrival H0 for the bus under consideration at the stop under consideration on the route under consideration, said time H0 corresponding to waiting time information communicated to the user on the last occasion the appliance was interrogated by the user;

to respond to the data received by the radio receiver means by taking account cyclically of data representative of an updated estimated time of arrival H for the bus under consideration at the stop under consideration on the route under consideration; and to actuate the signalling means when the times of arrival H and H0 differ by a duration ΔH greater than a certain limit.

By means of these dispositions, in the event of the waiting time and/or the time of arrival of the next bus as initially estimated and communicated to the user should turn out to be subject to significant error, then the user is warned that it is necessary to re-consult the portable appliance to find out the presently estimated waiting time and/or time of arrival concerning the next bus.

In preferred embodiments, use may optionally be made of one or more of the following dispositions:

the portable appliance is adapted to inform users about waiting times at a plurality of stops, the interrogation means being designed to enable the user to select a particular stop on a bus route belonging to the network, the central unit then being designed to inform the user at least about the waiting time for the bus under consideration at the selected stop on the selected route, and the central unit being adapted to store at least the latest stop to be selected by the user during the latest interrogation and also the corresponding bus route, together with the times of arrival H0 and H relating to said selected stop;

said limit corresponds to a predetermined duration;

said limit corresponds to a fraction of the time that remains until the initially estimated time of arrival H0;

said limit differs depending on whether the updated time of arrival H is earlier than or later than the initially estimated time of arrival H0;

said limit being constituted:

by a fraction of the time that remains until the initially estimated time of arrival H0 if said remaining time is greater than a predetermined duration or if the updated time of arrival H is later than the initially estimated time of arrival H0; and by a second predetermined duration when the remaining time until the initially estimated time of arrival H0 is less than the first predetermined duration and the updated time of arrival H is earlier than the initially estimated time of arrival H0;

the signalling means are adapted to emit an audible sound signal;

the signalling means are adapted to emit a plurality of different signals, the central unit being designed to cause the signalling means to emit different signals depending on whether the updated time of arrival H is earlier than or later than the initially estimated time of arrival H0;

the signalling means are adapted to emit a plurality of different signals, the central unit being designed to cause different signals to be emitted by the signalling means depending on whether the duration ΔH exceeds to a greater or lesser extent the above-mentioned limit from which signalling is triggered;

the interface means are display means, and the central unit is designed to cause the display means to display waiting information corresponding to the stop under consideration on the route under consideration, whenever said central unit actuates the signalling means; and the bus under consideration is the next bus that is expected to reach the stop under consideration on the bus route under consideration.

BRIEF DESCRIPTION OF THE DRAWINGS

Other characteristics and advantages of the invention appear from the following detailed description of an embodiment thereof given by way of non-limiting example and with reference to the accompanying drawing.

In the drawings:

FIG. 1 is a diagrammatic view of a line in a bus network;

FIG. 2 is a diagrammatic view of a bus stop on said bus line; and

FIG. 3 is a block diagram of a portable appliance constituting an embodiment of the invention.

MORE DETAILED DESCRIPTION

FIG. 1 is a diagram showing a bus line 1 forming part of an urban network, along which there run buses 2 represented in the figure by small triangles pointing in the direction of travel.

Bus line 1 comprises two routes A and B in opposite directions (i.e. one route in each direction) each route having different bus stops 3.

As explained in detail in document WO-A-94/02923, a central control point 4 (FIG. 2) picks up data, by radio or otherwise, relating to the position of each bus 2 travelling along each route A or B of the line 1, and of all the other lines in the bus network. On the basis of this data, the central control point 4 generates radio messages each containing, in particular, an identification for each bus 2 and data representative of the position of said bus 2, thereby making it possible to establish, in particular, the distance d between said bus and the next stop 3 on the route followed by the bus.

These radio messages are broadcast from the central control station 4 and they are received in particular by individual portable appliances 10 (FIG. 3) in the possession of users of the bus network.

Each portable appliance 10 comprises:

an antenna 11 associated with a radio message receiver device 12;

a message decoder circuit 13;

a memory 14;

a microprocessor 15;

a video screen 16 or other display device;

a keypad 17 or some other input device;

a battery 18 or some other self-contained electrical power supply; and a loudspeaker 19 or other sound signal emitter.

As explained in above-mentioned document WO-A-94/02923 or in document WO-A-94/02922, the microprocessor 15 is programmed:

to generate, on the basis of radio messages received from the central control point 4, information relating to the waiting time for the next bus(s) 2 at a given bus stop 3 on a given route of a bus network; and to cause said information to appear on the screen 16 when interrogated by the user.

When the display takes place, the waiting time for the next bus at the stop selected by the user corresponds to a certain instant H0 initially estimated for the arrival of said bus at the stop in question.

This initially estimated time of arrival H0 (or any other equivalent data) is stored in the memory 14 as is the corresponding stop in the bus network, together with the route followed by the bus which includes said stop and the bus line to which said route belongs.

Subsequently, even if the screen 16 has been switched off (either automatically or under user control), the portable appliance 10 continues cyclically to receive radio messages coming from the central control point 4.

From these radio messages, the microprocessor 15 selects those relating to the previously stored bus stop 3, i.e. the bus stop selected by the user when last interrogating the appliance 10.

On the basis of these radio messages, the microprocessor 15 cyclically recalculates an updated time of arrival H estimated for the next bus 2 at the stop 3 under consideration.

When (the absolute value of) the difference ΔH between H and H0 exceeds a certain limit, the microprocessor 15 actuates the loudspeaker 19 to emit a sound signal, thereby warning the user that it is necessary to consult the screen 16 of the appliance 10 again.

The microprocessor 15 also preferably also causes the screen 16 to operate and display the presently expected waiting time for the next bus 2 at the stop 3 under consideration, and/or the estimated time of arrival H for the next bus: in this way, the user does not need to operate the keypad 17 in order to check the updated waiting time for the next bus.

Depending on circumstances, the time threshold ΔH beyond which the sound signal is triggered is:

either a predetermined duration (e.g. a sound signal is triggered as soon as the difference ΔH exceeds 3 min);

or else a relative duration, e.g. corresponding to a fraction of the time that remains until the initially estimated time of arrival H0 for the next bus (for example a sound signal may be triggered when ΔH exceeds 50% of the time T0 that remains till the initially estimated time of arrival H0).

This limit may possibly differ depending on whether H is sooner than or later than H0.

Where appropriate, it could be envisaged that there is no need to warn the user unless H is earlier than H0 (bus ahead of estimate), even though this variant is not preferred.

Advantageously, the limit with which ΔH is compared is constituted as follows:

by a fraction (e.g. 50%) of the time T0 that remains until the initially estimated time of arrival H0 of the next bus, providing said time that remains is in excess of a first predetermined duration T1 (e.g. 5 min), or if the updated time of arrival H is later than the time of arrival H0 initially estimated for the next bus; and a second predetermined duration T2 (e.g. 30 seconds) when the remaining time T0 before the initially estimated time of arrival H for the next bus is less than the first predetermined duration T1 and the presently estimated time of arrival H for the next bus is earlier than the initially estimated time of arrival H0.

For example, it could happen that a user of the bus network consults the portable appliance 10 at 12:15, while selecting a particular bus line 1, one of the two routes A and B making up said line (i.e. one of the two directions for the line), and a particular stop 3 on that route.

The portable appliance 10 may then indicate, for example, an estimated waiting time of 15 min, corresponding to an initially estimated time of arrival for the next bus at the desired stop H0=12:30.

If at 12:20, the microprocessor 15 updates the estimated time of arrival H with a new estimate H=12:25, then the difference ΔH between H0 and H is 5 min, and the time T0 that remains until the initially estimated time of arrival H0 is 10 min.

This duration T0=10 min is greater than the first predetermined duration T1=5 min, such that the microprocessor compares the difference ΔH with the limit T0×50%=5 min.

Since ΔH reaches this limit, the microprocessor 15 causes a sound signal to be emitted by the loudspeaker 19 and for example, it can also cause the screen 16 to display the presently estimated waiting time T for the next bus at the desired stop 3, i.e. 5 min in the example under consideration.

Naturally, this display is accompanied by sufficient explanatory data to inform the user, for example, that the next bus which was expected to reach the desired stop 3 is ahead of the estimated time and that it is going to arrive in 5 min.

Using the same example as above, if at 12:20 the microprocessor 15 estimates that H is still 12:30, then it does not cause the loudspeaker 19 or the screen 16 to operate.

Thereafter, if for example at 12:26 the microprocessor 15 estimates that H=12:29, then ΔH=1 min and T0=4 min.

This duration T0=4 min is less than the first predetermined duration T1=5 min, such that the microprocessor 15 compares ΔH=1 min with the second predetermined duration T2=30 sec.

Since the difference ΔH=1 min is greater than T2=30 sec, the microprocessor 15 causes a sound signal to be emitted by the loudspeaker 19 and it simultaneously causes the screen 16 to display the presently estimated waiting time T for the next bus at the desired stop 3, i.e. 3 min in the example under consideration.

The loudspeaker 19 is preferably adapted to emit several distinct sound signals, in which case microprocessor 15 is advantageously designed to cause it to emit as follows:

a first sound signal (e.g. a single signal of relatively long duration, about 2 sec to 5 sec) when the difference ΔH is greater than the above-mentioned limit, but H is later than H0 (bus late);

a second sound signal (e.g. a run of spaced apart short signals) when ΔH is greater than the above-mentioned limit, and H is earlier than H0 (bus ahead of time), ΔH exceeding the above-mentioned limit by relatively little (e.g. ΔH does not exceed said limit by more than 10%); and a third sound signal (e.g. a run of close together short signals) when ΔH is greater than the above-mentioned limit, and H is earlier than H0 (bus ahead of time), with ΔH being considerably different from the above-mentioned limit (e.g. ΔH exceeds said limit by more than 10%).

Naturally, and as can be seen from the above, the invention is not limited to the particular embodiment described; on the contrary it extends to any variant, and in particular variants in which:

the information relating to the waiting time and/or the time of arrival of the next bus at various stops in the network is generated by the central control point 4 instead of being generated by each portable appliance 10, said information subsequently being transmitted to the various portable appliances by radio;

each portable appliance 10 serves to inform a user only about the waiting times at a predetermined stop in the bus network, in which case the keypad 17 is simplified, possibly being reduced to a single on/off button;

the screen 16 could be replaced by some other interface, e.g. a voice synthesizer;

the various sound signals that can be emitted by the loudspeaker 19 may differ from one another not only by their modulation, but also by their frequency, or indeed by both their modulation and their frequency, simultaneously;

the loudspeaker 19 could be replaced by or accompanied by a light signal emitter and/or a vibrator capable of emitting vibrations that can be felt by a user wearing the appliance 10 on the person, said light signal emitter and/or said vibrator being adapted, where appropriate, to emit light signals and/or vibration signals that differ depending on circumstances, said various signals differing from one another, where appropriate, in frequency (wavelength) and/or in modulation; and the waiting time information given by the appliance 10 need not relate to the next bus, but may relate to a particular bus that is not necessarily the next bus expected at the stop in question.

We claim:

1. A portable appliance for informing users of a bus network about waiting times at at least one stop on at least one bus route belonging to said network, the appliance comprising:

radio receiver means for receiving by radio data enabling the above-mentioned waiting times to be known;

interrogation means actuatable by a use to access waiting time information to inform said user on at least the waiting time for a certain bus at the stop under consideration on the route under consideration, said waiting time information corresponding to a certain estimated time of arrival for the bus under consideration at the stop under consideration; and interface means controlled by an electronic central unit for communicating said waiting time information to the user, the appliance further including signalling means suitable for attracting the user's attention; and the central unit is adapted:

to store at least data representative of an estimated time of arrival H0 corresponding to said waiting time information communicated to the user on the last occasion the appliance was interrogated by the user;

to respond to the data received by the radio receiver means by taking account cyclically of data representative of an updated estimated time of arrival H for the bus under consideration at the stop under consideration on the route under consideration;

to actuate the signalling means when the updated estimated time of arrival H and the estimated time of arrival H0 differ by a duration ΔH greater than a certain limit; and to update the estimated time of arrival H0 with the updated estimated time of arrival H when the appliance is interrogated.

2. A portable appliance according to claim 1, adapted to inform users about waiting times at a plurality of stops, the interrogation means being designed to enable the user to select a particular stop on a bus route belonging to the network, the central unit then being designed to inform the user at least about the waiting time for the bus under consideration at the selected stop on the selected route, and the central unit being adapted to store at least the latest stop to be selected by the user during the latest interrogation and also the corresponding bus route, together with the times of arrival H0 and H relating to said selected stop.

3. A portable appliance according to claim 1, in which said limit corresponds to a predetermined duration.

4. A portable appliance according to claim 1, in which said limit corresponds to a function of the time that remains until the estimated time of arrival H0.

5. A portable appliance according to claim 1, in which said limit differs depending on whether the updated time of arrival H is earlier than or later than the estimated time of arrival H0.

6. A portable appliance according to claim 1, in which said limit is constituted as follows:

by a fraction of the time that remains until the estimated time of arrival H0 if said remaining time is greater than a predetermined duration or if the updated time of arrival H is later than the estimated time of arrival H0; and by a second predetermined duration when the remaining time until the estimated time of arrival H0 is less than the first predetermined duration and the updated time of arrival H is earlier than the estimated time of arrival H0.

7. A portable appliance according to claim 1, in which the signalling means are adapted to emit an audible sound signal.

8. A portable appliance according to claim 1, in which the signalling means are adapted to emit a plurality of different signals, the central unit being designed to cause the signalling means to emit different signals depending on whether the updated time of arrival H is earlier than or later than the estimated time of arrival H0.

9. A portable appliance according to claim 1, in which the signalling means are adapted to emit a plurality of different signals, the central unit being designed to cause different signals to be emitted by the signalling means depending on whether the duration ΔH exceeds to a greater or lesser extent the above-mentioned limit from which signalling is triggered.

10. A portable appliance according to claim 1, in which the interface means are display means, and the central unit is designed to cause the display means to display waiting information corresponding to the stop under consideration on the route under consideration, whenever said central unit actuates the signalling means.

11. A portable appliance according to claim 1, in which the bus under consideration is the next bus that is expected to reach the stop under consideration on the bus route under consideration.

* * * * *